US005813948A

United States Patent [19]

Quigg et al.

[11] Patent Number: 5,813,948

[45] Date of Patent: Sep. 29, 1998

[54] WALKER

[76] Inventors: Robert T. Quigg, 118 Hickory Dr.; James A. Reynolds, 119 Hickory Dr., both of Hatfield, Pa. 19440

[21] Appl. No.: 785,202

[22] Filed: Jan. 17, 1997

[51] Int. Cl.[6] ..... A63B 22/00

[52] U.S. Cl. ..... 482/67; 482/66; 280/87.05; 280/87.041

[58] Field of Search ..... 297/5; 482/65, 482/67, 66; 280/87.021, 87.005, 87.041

[56] References Cited

U.S. PATENT DOCUMENTS

| | | | |
|---|---|---|---|
| 509,991 | 12/1893 | Wood | 280/87.05 |
| 1,223,707 | 4/1917 | Lyon | 280/87.05 |
| 2,278,901 | 4/1942 | Smock | 482/67 |
| 3,398,974 | 8/1968 | Edwards et al. | 295/297.5 |
| 4,312,505 | 1/1982 | Engelhart . | |
| 4,342,465 | 8/1982 | Stillings . | |
| 4,770,410 | 9/1988 | Brown . | |
| 4,966,362 | 10/1990 | Ramaekers | 482/65 |
| 5,083,806 | 1/1992 | Brown . | |
| 5,380,262 | 1/1995 | Austin | 297/5 |
| 5,476,432 | 12/1995 | Dickens | 482/67 |

FOREIGN PATENT DOCUMENTS

| | | | |
|---|---|---|---|
| 4215879 | 1/1993 | Germany | 482/92 |

*Primary Examiner*—Jerome Donnelly
*Attorney, Agent, or Firm*—Joseph W. Molasky & Associates

[57] ABSTRACT

An adult walker having a suspended seat assembly which may be adjusted to accommodate the user. Included is an adjustable support frame which may be raised and lowered with respect to the walking surface. This walker is accessed from the rear, making it safer and easier to enter and exit. Also included is a ramp for ease of access by a wheelchair user.

8 Claims, 8 Drawing Sheets

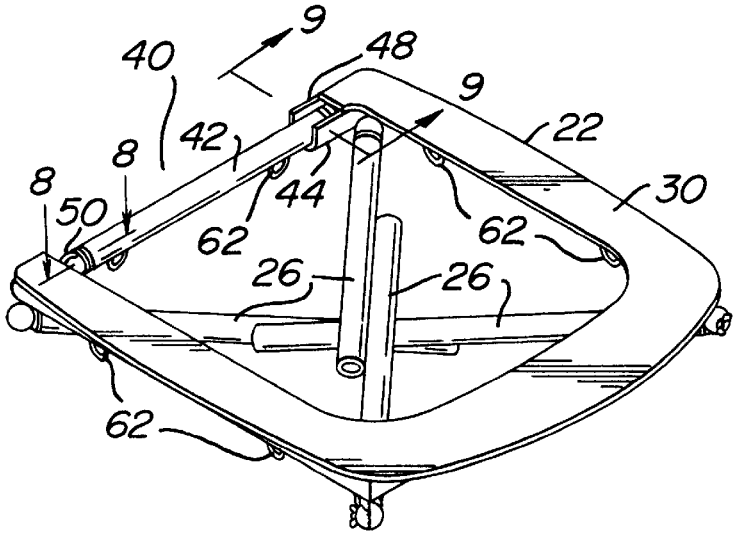
FIG. 2
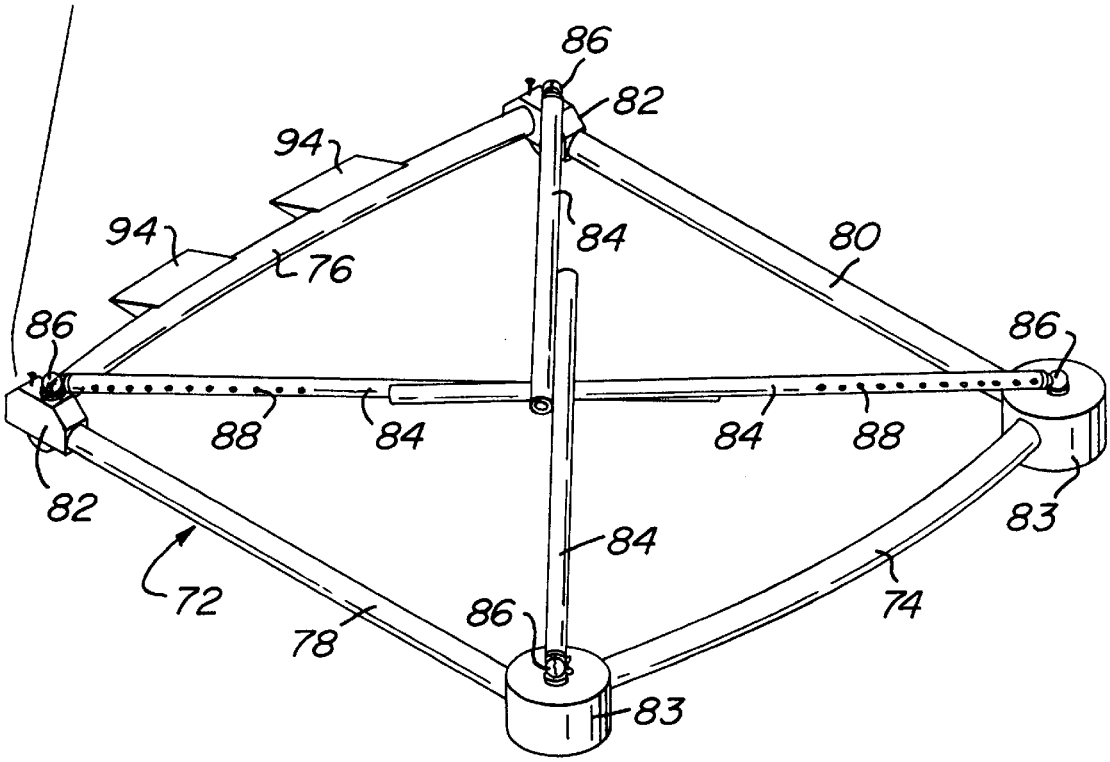

FIG. 3
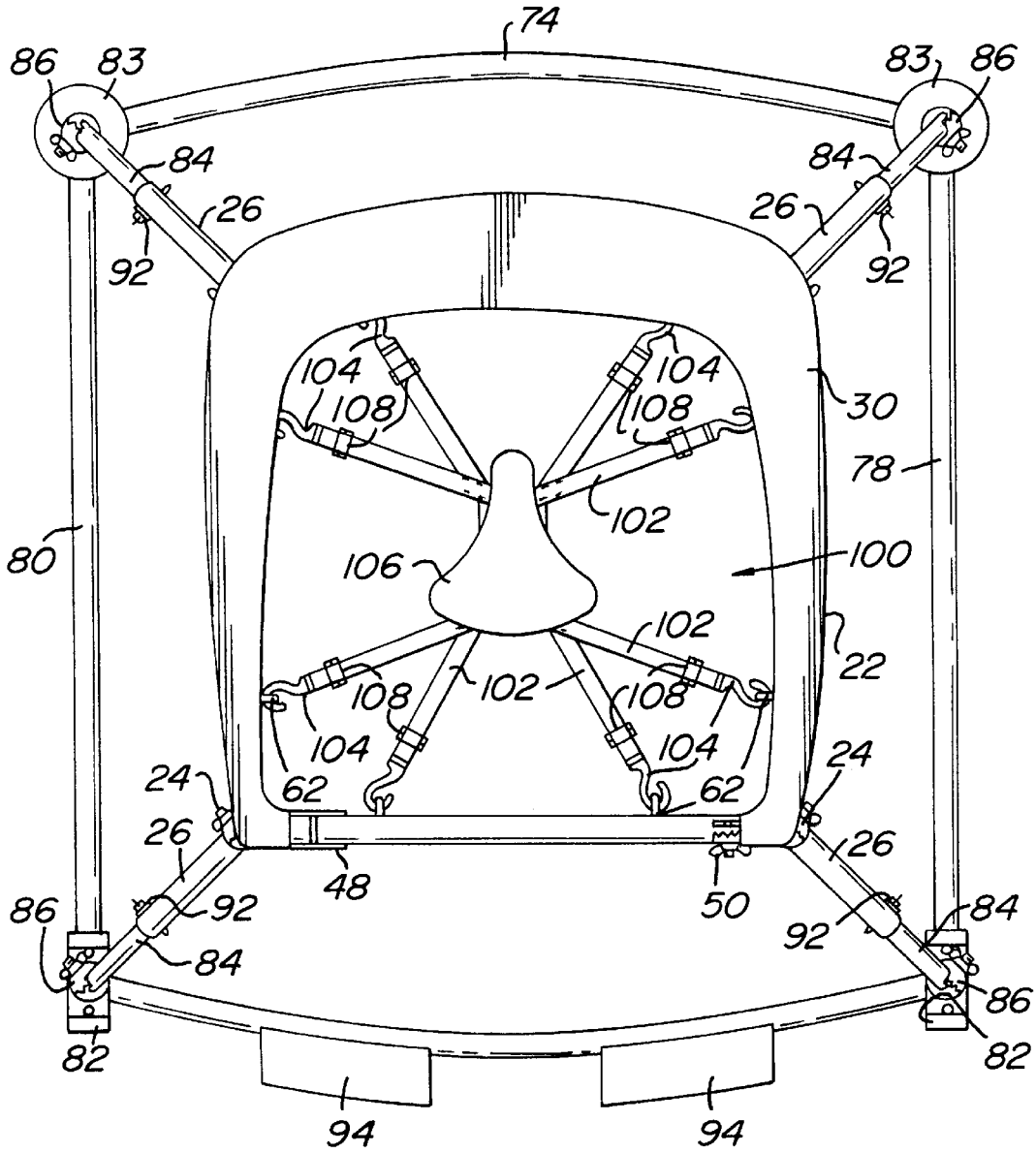
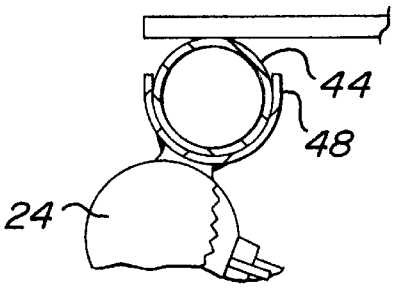
FIG. 9

FIG. 5
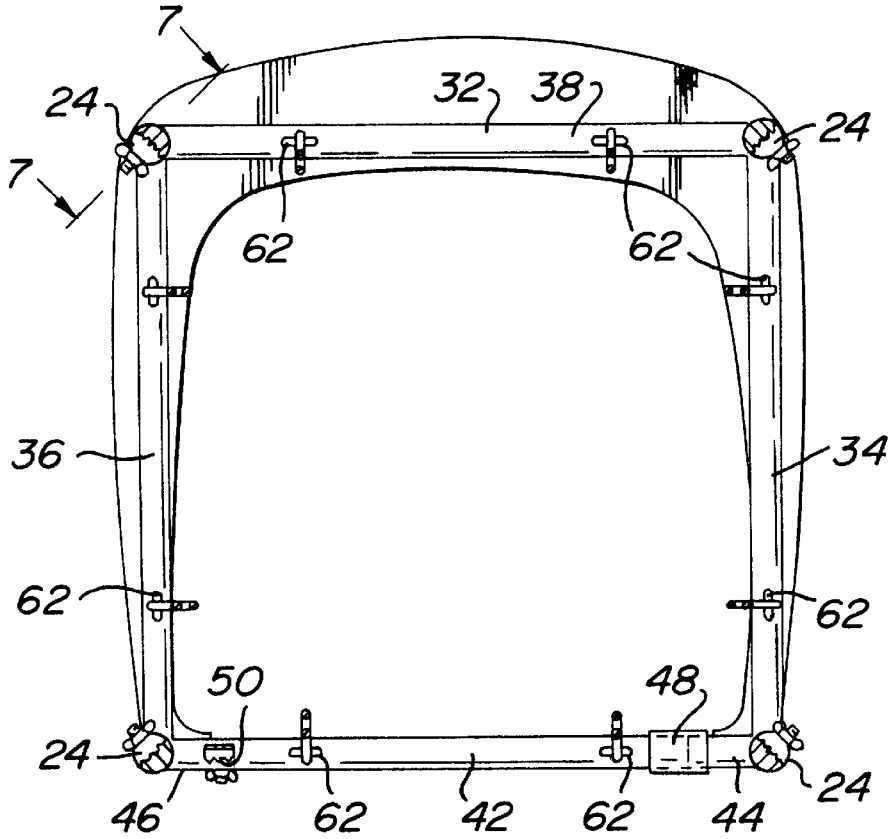
FIG. 7
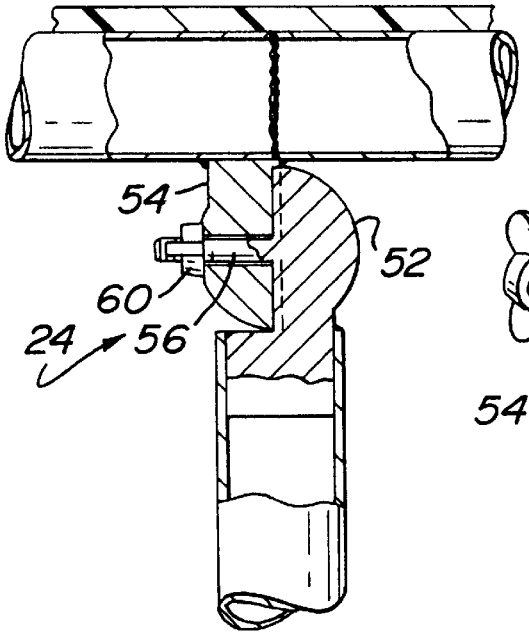
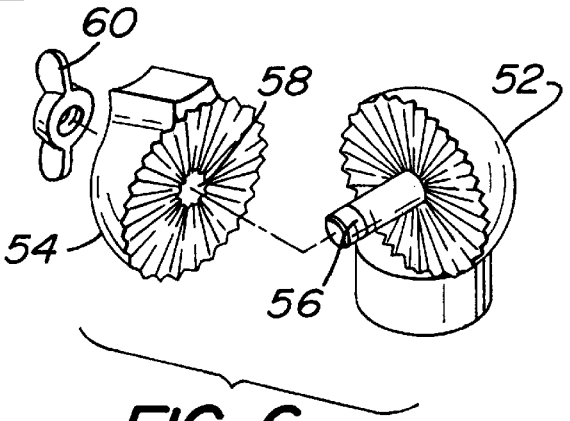
FIG. 6

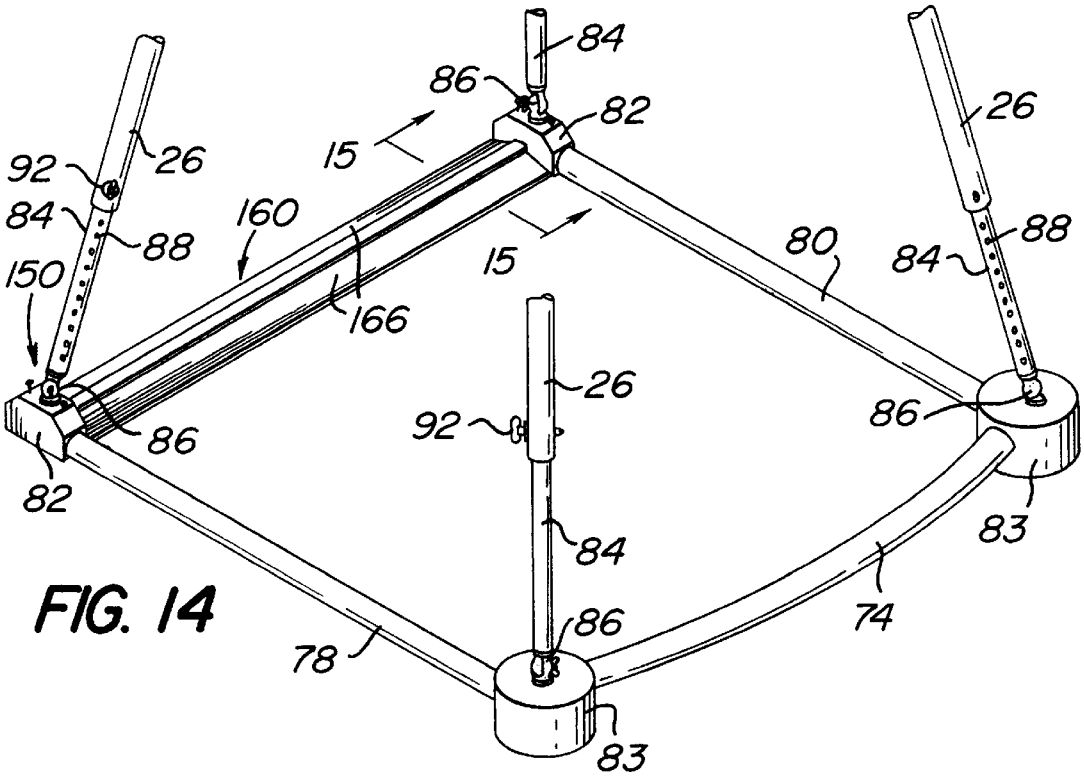
FIG. 14
FIG. 15
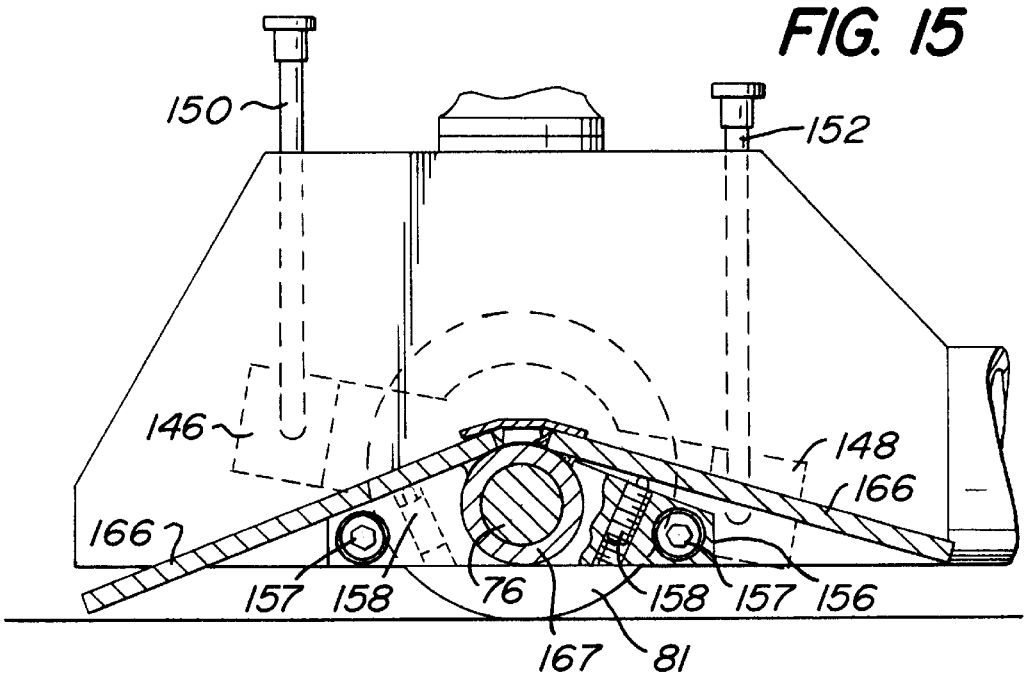

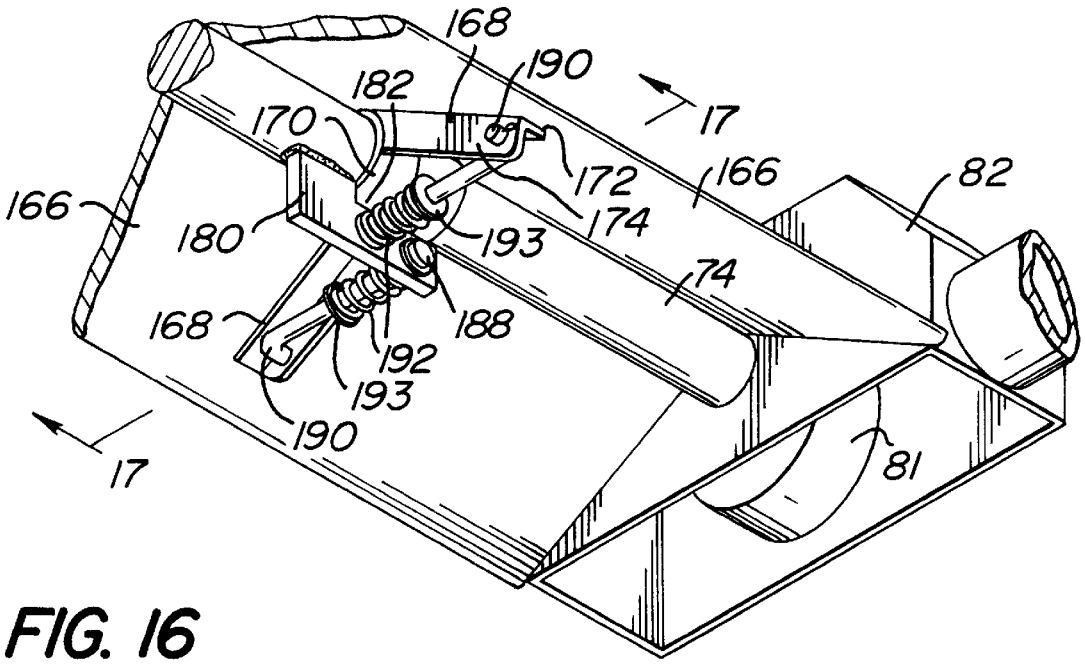
FIG. 16
FIG. 17
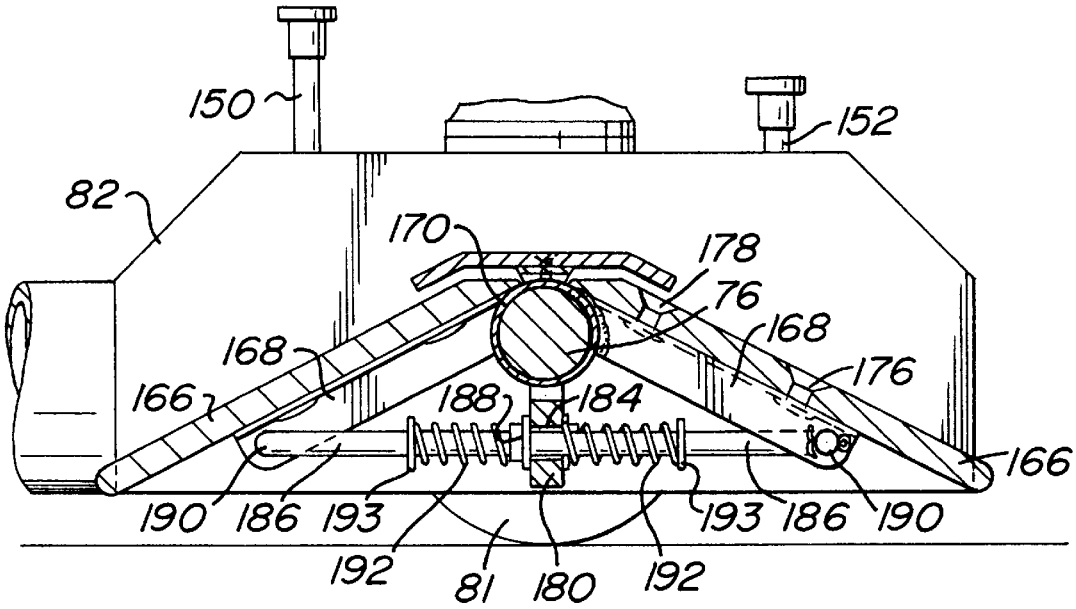

WALKER

BACKGROUND OF THE INVENTION

This invention relates to a device for assisting the handicapped and/or others who have difficulty ambulating.

More particularly, this invention relates to an improved walker which is easily accessible and which may be adjusted to accommodate users of various size and which can be easily assembled and disassembled for storage or shipping.

There are various walkers in the art designed for use by adults including those with wheels and/or castors and a framework that encompasses the user. One such example is found in U.S. Pat. No. 4,312,505 to Engelhart which shows a generally U-shaped base frame having wheels/castors mounted thereon to provide a rolling platform, and a support frame coupled to the base frame to provide the user with a structure which can be grasped. A removable rear cross bar and belt is provided to support a safety belt for securing purposes.

Other walkers provide a surrounding structure that also include a rigid seat. Examples of such devices include those shown in U.S. Pat. No. 4,342,465 to Stillings; U.S. Pat. No. 4,770,410 to G. Brown; and U.S. Pat. No. 5,083,806 to M. Brown. With these, the user must move backward into the device because the seat is accessible only from the front. This requires the handicapped or incapacitated user to maneuver backwards, a very difficult task and one that could lead to serious injury. This front-entry method also makes it necessary or desirable for the user of the device to have assistance in entering and exiting the device.

It has also been found desirable to adjust the height of the device so that users of different sizes and/or needs can be accommodated. Although the height of some prior art devices is adjustable by raising or lowering a top frame portion with respect to the walking surface, the seat portion is not separately adjustable. This means that the user must get in and out of the device to perform the adjustment or have an assistant on hand to help adjust the frame to the desired level.

SUMMARY OF THE INVENTION

The present invention provides for an adult walker having a suspended seat assembly for supporting the user. The seat assembly is adjustable separate and apart from adjustments made to the upper support frame for raising or lowering the top frame with respect to the walking surface. The walker is accessed from the rear, making it safer and easier for a user to enter and exit the device.

The walker of the present invention comprises a four-sided upper support frame; a four-sided lower base frame coupled to said upper support frame and a plurality of wheels attached thereto; including also an adjustable seat assembly comprised of a plurality of support straps suspended from said four-sided upper frame, adjustment means attached to said support straps for enabling the lengthening or shortening of the effective length of said support straps, and a seat supported by said support straps.

In a preferred embodiment, one side of the four-sided upper support frame comprises a moveable gate, facing the rear of the walker, moveable into an open position to allow access to the walker from the rear.

In another preferred embodiment, the four-sided lower base frame includes ramp means for assisting in access to the device by an individual confined to a wheelchair, and in a most preferred form the ramp means is spring-loaded so that it is biased to an upper position to keep it from touching the ground and can be urged to touch the ground by force exerted upon the ramp means.

These and other features and advantages of the invention will become apparent to those skilled in the art upon a reading of the following description in connection with the drawings, wherein like numerals refer to like parts throughout.

BRIEF DESCRIPTION OF THE DRAWINGS

FIG. 2 is an exploded isometric view showing the device of FIG. 1 in a disassembled mode.

FIG. 3 is a top plan view of the device shown in FIG. 1.

FIG. 5 is a cross-sectional view taken along line 5—5 of FIG. 1.

FIG. 6 is an exploded isometric view showing the adjustable pivot means by which the support frame is joined to the upper and lower assemblies.

FIG. 7 is a cross-sectional view taken along line 7—7 of FIG. 5.

FIG. 9 is a cross-sectional view taken along line 9—9 of FIG. 2.

FIG. 14 is a perspective view showing an alternative ramp configuration.

FIG. 15 is a cross-sectional detail view taken along line 15—15 of FIG. 14.

FIG. 16 is a partial perspective view of the alternative ramp shown in FIG. 14 seen from the underside.

FIG. 17 is a cross-sectional detail drawing taken along line 17—17 of FIG. 16.

DETAILED DESCRIPTION OF THE PREFERRED EMBODIMENTS

Figure 1:
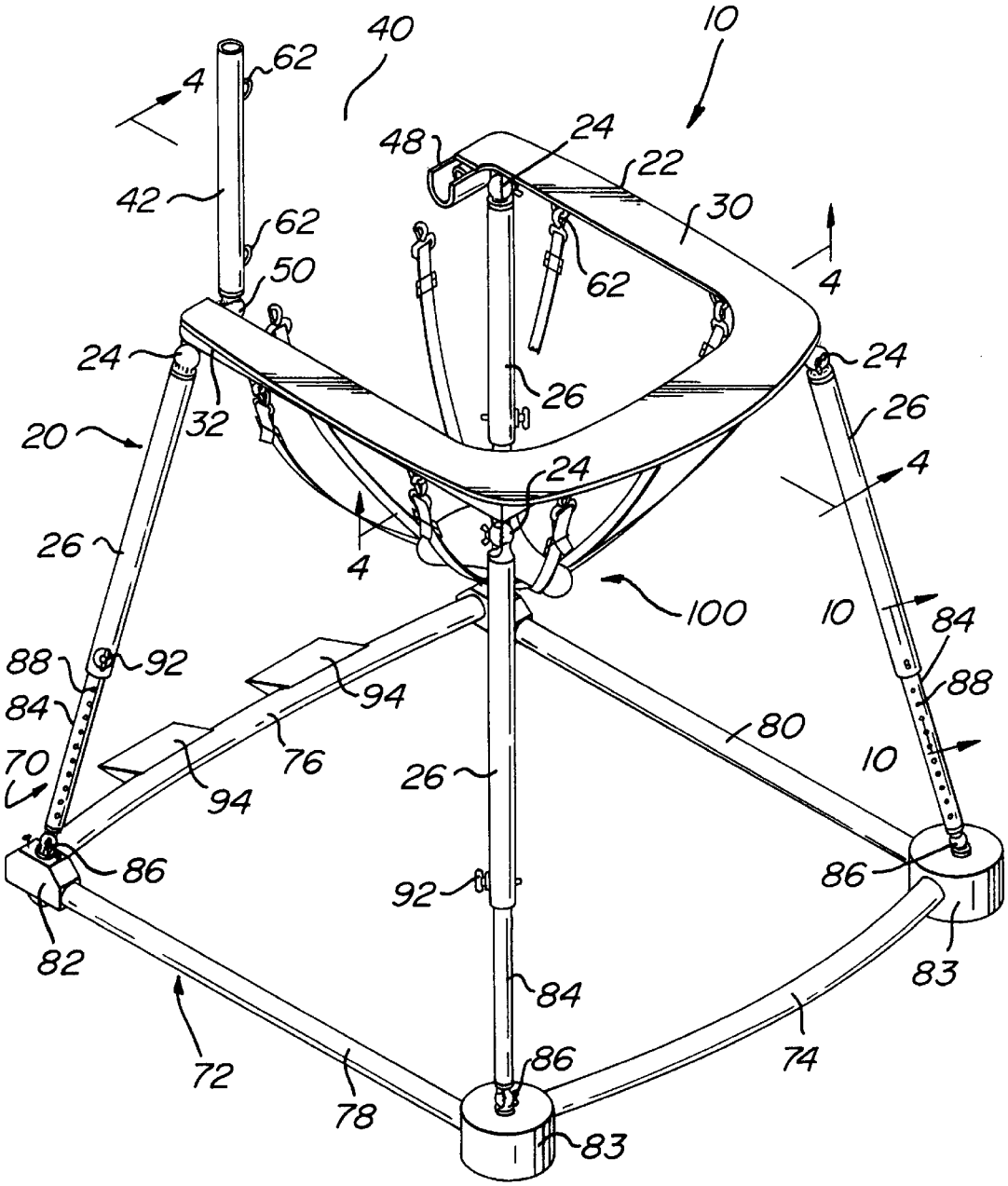
FIG. 1 is an exploded isometric view of the walker device of this invention.
Figure 4:
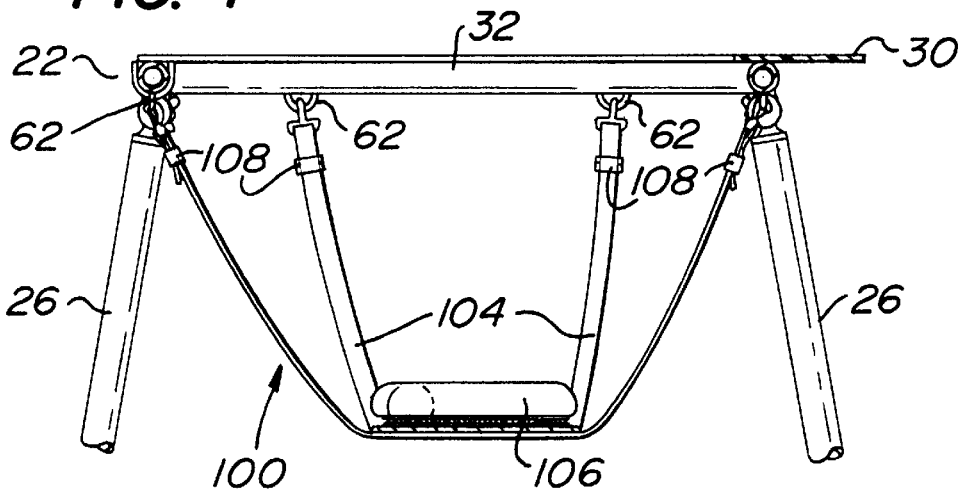
FIG. 4 is a cross-sectional view taken along line 4—4 of FIG. 1.

The walker of this invention is shown generally in FIG. 1 as device 10 and comprises an upper support frame 20, a lower base frame 70, and a seat assembly 100.

Support frame 20 comprises a tray member 22, four support frame adjustable joints 24, and four support frame legs 26. Tray member 22 is a generally square-shaped assembly having an opening in the middle in which a user of the device may sit or stand. Tray member 22 comprises a generally flat U-shaped top member 30, a U-shaped sub-frame member 32, and a gate assembly 40. Flat U-shaped top member 30 can be constructed from any flat, sheet-like material such as, for example, plywood. Flat U-shaped top member 30 sits on top of sub-frame member 32 and is connected thereto using any known connection means as, for example, screw means. Flat U-shaped top member 30 provides a surface much like a table top for writing or for conducting other activities that require a flat surface. In addition, the edge portion of the top member 30 provides the user of the device with a grasping means so that he or she may stabilize themselves while entering or exiting or while the walker is in use.

Sub-frame member 32 (best shown in FIG. 5) is mounted to the underside of the flat U-shaped top member 30 and may comprise three hollow tubular sections 34, 36, and 38. These tubular sections are of substantially the same length and coupled to one another at right angles, in the same plane, to form the U-shaped sub-frame member 32 as shown in FIG. 5. The sub-frame member 32 provides additional structural integrity to the walker and, in connection with the remainder of the walker as described below, forms a "cage" structure which protects the user.

Gate assembly 40 is coupled across the open end of the U-shaped structure formed by the conjoined flat U-shaped top member 30 and sub-frame member 32; the gate assembly "closes" the U formed by the top member 30/sub-frame 32 to form the square enclosure that surrounds a user of the walker. The gate assembly 40 comprises a gate arm 42, two short hollow end sections 44 and 46, gate arm receiving socket 48, and gate arm adjustable joint 50. The gate arm 42 can comprise a slightly shorter section of hollow tubing than that used to form tubular sections 34, 36, and 38; the combined length of the two end sections 44 and 46 and the gate arm 42 should be approximately equal to the length of one of the tubular sections 34, 36, or 38.

The gate arm 42 must be able to pivot at one end so that it can be moved out of the way to allow the user to enter the walker. End section 44 is attached to the end of tubular section 34 as shown in FIG. 3. It should be attached at a right angle relative to tubular section 34 and in the same plane as the U-shaped sub-frame member 32. One end of gate arm 42 is then pivotally coupled to the end section 44 via gate arm adjustable joint 50, described in more detail below.

End section 46 is coupled to the end of tubular section 36 in a manner identical to the coupling of end section 44 to tubular section 34, that is, end section 46 is attached at a right angle relative to tubular section 36 and in the same plane as the U-shaped sub-frame member 32. Gate arm receiving socket 48, which may comprise a U-shaped socket of a size into which the gate arm 42 can fit, is attached to the short tubular section 46 as shown in FIG. 1, leaving an open area into which the gate arm 42 can rest when gate arm 42 is in the closed position.

This is only one of many possible configurations for gate assembly 40. For example, if it is desired to maximize the entrance opening, the recessed socket 48 and adjustable joint 50 can be moved to a more outward position and the length of the gate arm 42 increased accordingly, thereby eliminating the need for the right-angled end sections 44 and 46.

As shown in FIGS. 1 and 2, support frame legs 26 are coupled to each of the four corners of the tray member 22. The connection between each of the support frame legs 26 and the corners of the tray member 22 must be adjustable so that the angle of the legs 26 with respect to the tray member 22 can be adjusted as needed. This is accomplished by utilizing adjustable joints 24. One embodiment of an adjustable joint 24 is shown in detail in FIG. 6 and the connection of adjustable joint 24 to a corner of the tray member 22 is shown in FIG. 7. As shown in FIGS. 6 and 7 for this embodiment, each adjustable joint 24 comprises a generally hemispherical-shaped male member 52 and a generally hemispherical-shaped female member 54 which, when coupled together, form the complete joint. The inner edges of each hemisphere are serrated as shown to form teeth that mesh together when the two hemispheres are coupled to each other. The male member 52 includes a threaded stud 56 which is inserted through hole 58 in female member 54. A wing nut 60 turned on to threaded stud 56 tightens or loosens the connection between the male member 52 and female member 54 to allow adjustment to the desired angle.

One of the female members 54 of the adjustable joints 24 is coupled to each of the junctions of the tubular sections 34, 36, 38, 44, and 46; thus a female member 54 is located at each corner of the U-shaped sub-frame member 32. One of the male members 52 of the support frame adjustable joints 24 is coupled to one end of each of the support frame legs 26. The male members 52 and female members 54 are then coupled to each other, yielding four support frame legs attached to each of the four corners of the U-shaped sub-frame member 32 as shown in FIG. 1. By loosening the wing nut 60 of each adjustable joint 24 and then moving the male member 52 relative to the female member 54, the angle of support frame leg 26 with respect to the U-shaped sub-frame member 32 can be adjusted to suit the needs of the particular user of the device. As shown in FIG. 2, the angle can be adjusted so that the support frame legs 26 can be completely folded up for storage or transporting purposes.

Figure 8:
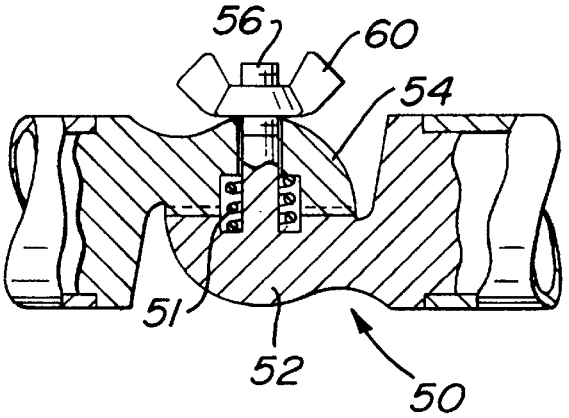
FIG. 8 is a cross-sectional view taken along line 8—8 of FIG. 2.

As shown in more detail in FIG. 8, gate arm adjustable joint 50 is identical to adjustable ball joints 24 except that gate arm adjustable joint 50 includes a spring 51 to urge the separation of the male and female members of the joint when the wing nut 60 is loosened. This is desired because the gate arm adjustable joint will be loosened and tightened with greater frequency than the other joints; this occurs because it is part of the gate assembly 40 and the gate arm 42 is lifted each time a user enters or leaves the device.

The lower base frame 70 comprises a generally square-shaped frame 72 set on wheels or castors 81 that are covered by wheel shrouds 82 and 83 (see FIGS. 1–3). The generally square-shaped frame comprises front member 74, back member 76, and side members 78 and 80. The front member 74 may be slightly curved toward the front of the walker and the back member 76 may be slightly curved toward the rear (see FIGS. 1 and 2) so as to maximize the area in which the user may perambulate.

The front member 74, back member 76, and side members 78 and 80 may be constructed from hollow tubing joined by known means to form the generally square shape shown in FIGS. 1 and 3.

Figure 11:
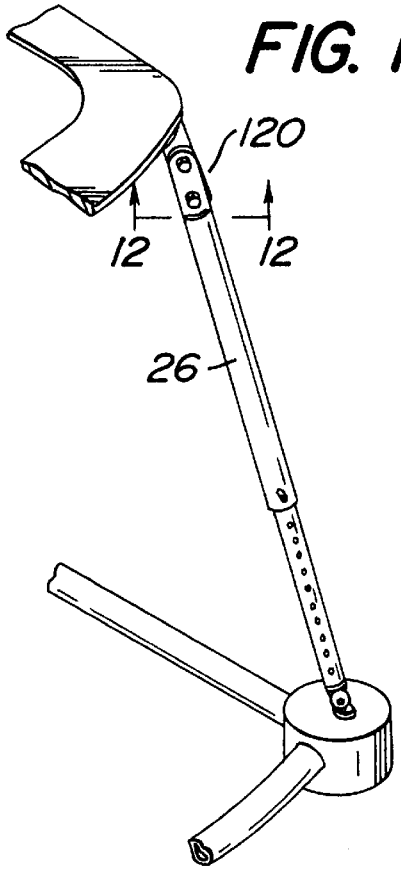
FIG. 11 is a partial side elevational view of an adjustable leg shown within alternative coupling means.
Figure 12:
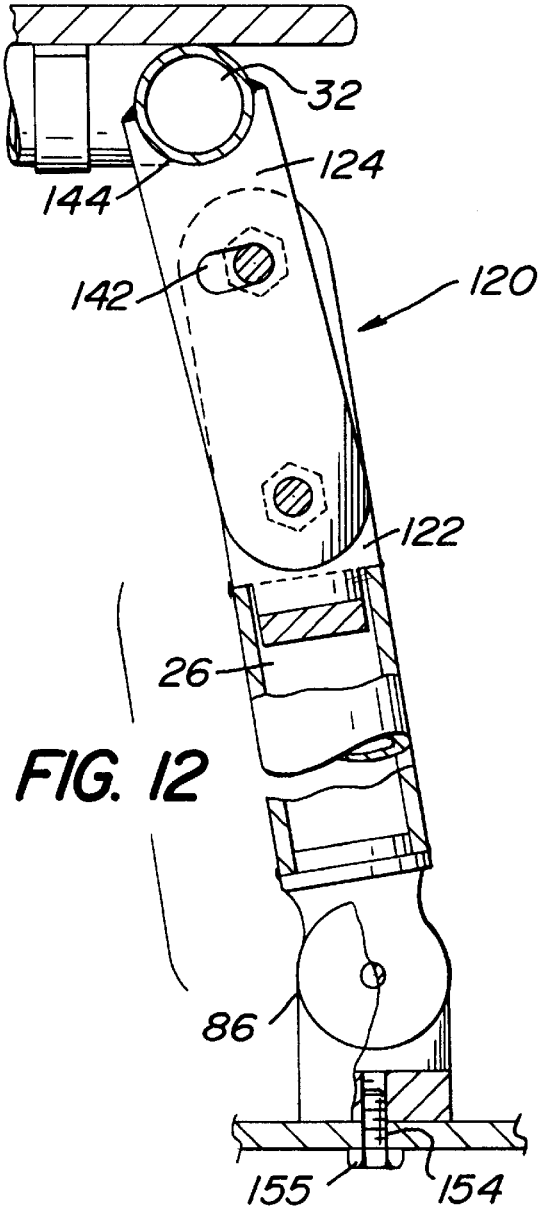
FIG. 12 is a partial cross-sectional detail view taken along line 12—12 of FIG. 11.
Figure 13:
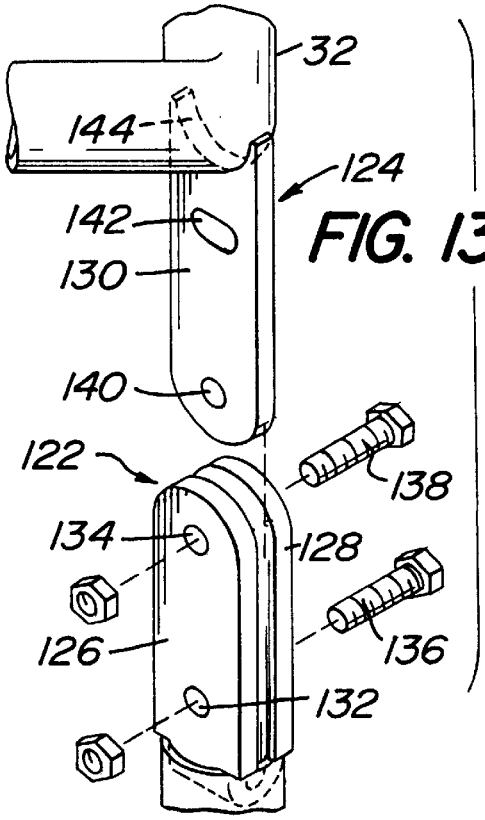
FIG. 13 is a partial perspective exploded view of the alternative coupling means shown in FIG. 11.

A preferred form of the adjustable joint is shown in FIGS. 11–13. This preferred adjustable joint 120 utilizes a "pickle fork" arrangement in which a receiving member 122 is coupled to an insertion member 124. Receiving member 122 resembles a two-tined fork in which the tines 126 and 128 are blade-shaped and are oriented such that the flat "face" of each tine 126 and 128 are essentially parallel to each other and separated from each other by a distance essentially equal to the thickness of blade member 130 of insertion member 124.

The tines 126 and 128 of receiving member 122 each have two apertures 132 and 134 formed therein for receiving mounting bolts 136 and 138, respectively (see FIG. 13). Blade member 130 of insertion member 124 has apertures 140 and 142 formed thereon, said apertures 140 and 142 corresponding to apertures 136 and 138, respectively, of receiving member 122. Aperture 142 of blade member 130 is slotted so that some adjustment of the position of the blade member 130 within the tines 126 and 128 of receiving member 122 is possible; the blade member 130 can pivot about the mounting bolt 136 when the mounting bolt 138 is loosened.

The end of receiving member 122 is coupleable to the support legs 26 using any conventional connection means, for example, by pressure fitting the end into the leg 26 as shown in FIG. 12. The end of insertion member 124 is coupled to sub-frame member 32 (one at the approximate location of each of the corners of sub-frame member 32) by any conventional means, for example, welding. By forming the end of insertion member 124 with a curve 144 as shown in FIG. 13, the insertion member 124 can be easily welded to the curved surface of sub-frame member 32.

Eyes 62 (FIGS. 1–5) are simply U-shaped loops formed on the underside of the sub-frame member 32 and are used, as described more fully below, to secure the seat assembly 100 to the upper support frame 20. For example, as shown in FIG. 1, front member 74 can be welded between wheel shrouds 83; back member 76 can be welded between wheel shrouds 82; and side members 74 and 76 can be welded between wheel shrouds 82 and 83. The length of the front member 74, back member 76, and side members 78 and 80 are selected so that the size of the generally square-shaped frame 72 is proportionally larger than the size of the generally square shaped tray member 22; this provides greater stability for the walker and, therefore, provides greater protection for the user of the walker.

At each corner and extending upwardly from the generally square frame 72 is a bottom leg 84, each comprised of a hollow tubular member having an outside diameter that allows it to fit snugly inside an associated support frame leg 26. Each base frame leg 84 is coupled to the square frame 72 via a base frame adjustable joint 86 which may be identical in construction to the support frame adjustable joints 26 described above for FIGS. 6 and 8 and FIGS. 11–13. Just as with the support frame legs 26, the angle of the base frame legs 84 relative to the square frame 72 are fully adjustable.

The wheels/castors 81 are situated on the underside of each corner of the square frame 72 and are attached by conventional means. The wheels/castors allow the walker to glide easily across the walking surface as the walker is pushed by the user.

In the preferred embodiment, the directional position of the rear wheels is fixed, i.e., the wheels are always facing forward. The directional position of the front wheels is rotatable so that, for example, as the user pushes the walker to the right the directional position of the front wheels points to the right, allowing the walker to be easily steered. Wheel shrouds 82 and 83 cover the wheels; the shrouds prevent a user or other person nearby the walker from getting fingers, toes, etc caught under the wheels.

As can be seen from FIGS. 1 and 2, the front shroud 83 is cylindrical in shape and comprises what is essentially an inverted cup; this shape allows for the rotation of the directional position of the wheel within the shroud, allowing it to rotate a full 360 degrees. Since the directional position of the rear wheels 81 is fixed, the shrouds 82 (shown in detail in FIGS. 15–17) can be essentially "box-shaped." A hole 154 formed in the top of each shroud (see FIG. 12) allows the insertion of a bolt 155 therethrough to attach the adjustable joints 86 to the shrouds. The wheels, which typically have a mounting plate for attachment to an upper surface, are mounted to the inside of the top of each mounting shroud using the mounting plate (not shown).

As shown in phantom lines in FIG. 15, in the preferred embodiment, the brake arm of a conventional wheel is modified so that it can be activated with the shroud 82 in position over the wheel. This modification requires the extension of the conventional brake arm by including "wings" 146 and 148 thereon and then connecting activation and deactivation rods 150 and 152 thereto. In this configuration, the brake mechanism of the conventional fixed wheel can be activated from outside of the shroud 82.

The seat assembly 100 comprises a plurality of straps 102 that are connected at each end to eyes 62. As shown in FIGS. 1 and 3, four straps 102 are connected in a "criss-cross" manner across the upper support frame 20. The ends of straps 102 are connected to eyes 62 via hooks 104. The straps are of sufficient length so that they hang below the level of the uppers support frame 20 and form a "basket-like" formation. A seat 106 is situated in the basket-like area and appropriately attached to the straps 102 in any known manner. Adjustment clips 108 allow the length of the straps to be adjusted so that a user can lower or raise the position of the seat 106 relative to the ground. This adjustment can be accomplished by the user of the walker, while in the walker, with little or no supervision.

As can be seen in FIG. 1, there are two eyes 62 attached to the gate arm 42. With the straps 102 attached to the eyes on the gate arm 42 and the user seated or supported by the seat assembly 100, the gate arm 42 is held in the closed position within gate arm receiving socket by the weight of the user.

Figure 10:
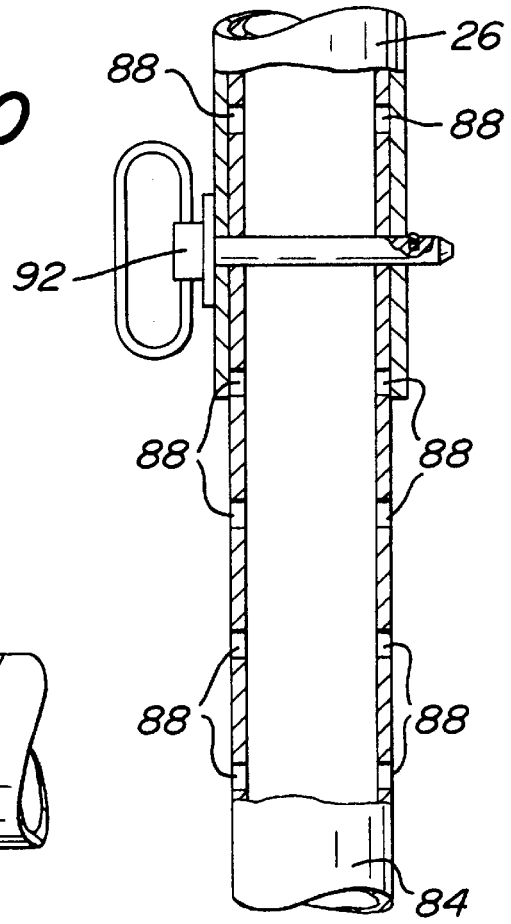
FIG. 10 is a cross-sectional view of a support bar shown with a locking pin in place.

Referring again to FIG. 1, it will be seen that base frame legs 84 contain a series of holes 88 arranged in a linear pattern and, also, a single hole 90 in the bottom end of each of the support frame legs 26. The holes 88 and 90 are formed such that, when a base frame leg 84 is inserted into a corresponding support frame leg 26, the single hole 90 in each support frame leg 26 can be aligned with the holes 88 in the support frame legs 84. As shown in detail in FIG. 10, a leg adjustment pin 92 is insertable into and through the aligned holes to secure the legs in a desired position. As the upper support frame 20 is raised or lowered with respect to the ground (and with respect to the base frame 70), it may become necessary to adjust the angle of the support frame legs 26 with respect to the sub-frame member 32 and the angle of the base frame legs 84 with respect to the base frame 70. This is easily accomplished by adjustment of the adjustable joints 24 as described above.

In practice, the walker is used by loosening wing nut on the gate arm adjustable joint 50 a few turns until the spring 51 urges the male and female members apart sufficiently to pivot the gate arm 42. The hooks 104 of the straps 102 that are attached to the eyes 62 of the gate arm 42 are then unhooked and the gate arm 42 is pivoted up and out of the way to allow the user to step inside the upper support frame 20. Once the user is inside the support frame 20, the gate arm 42 is lowered into the closed position, the wing nut of the gate arm adjustable joint 50 is tightened, and the straps 102 are passed through the legs of the user and are reconnected to the eyes 62 on the gate arm. If the user wishes to adjust the level of the seat 106, this is accomplished by moving the adjustment clips 108 until the desired height is attained. Once in this position, the walker is then in its operable mode.

It is contemplated that some of the users of the walker of the present invention will be utilizing a wheelchair when they are not using the walker. To aid in access to the device by a user who is confined to a wheelchair, ramps 94 can be attached to back member 76 of base frame 70, as shown in FIGS. 1, 2, and 9. According to this embodiment, two ramps 94 are provided; the centers of the two ramps 94 should be spaced apart at a distance approximately equal to the distance between the right and left wheels of a wheelchair.

In an alternative embodiment, shown in FIGS. 14–17, a single, wide, spring-loaded ramp 160 is attached to back member 76 of base frame 70. As described more fully below, back member 76 acts as an axle on which spring-loaded ramp 160 pivots.

A first embodiment of the spring mechanism for spring-loaded ramp 160 is described with reference to FIG. 15. As shown in FIG. 15, ramps 166 are connected to an elongate sleeve 167. Back member 76 is inserted through the elongate sleeve 167 before it is mounted to the walker.

To achieve the spring action, two spring housings 156 (one shown in FIG. 15) is utilized, one each being attached the exterior wall of each of the wheel shrouds 82, using screws 157 or other conventional attachment means. Spring pins 158 are inserted into apertures formed in spring housing 156. Spring pins 156 are spring-loaded pins that are depressed into the spring housing 156 when pressure is exerted on them as a result of pressure being exerted on ramp 166, but which will urge the ramp 166 upward when the pressure is released.

Although not shown, the spring housings 156 have a mounting hole formed therethrough coincident with and slightly larger than the diameter of the back member 76, so that back member 76 can connect to the wheel shroud 82 through the spring housing 156.

A preferred embodiment of spring loaded ramp is described with reference to FIG. 17. In the preferred embodiment, spring-loaded ramp 160 comprises first ramp member 162 and essentially identical second ramp member 164. The following detailed description, while limited to first ramp member 162, applies equally to second ramp member 164, and like numerals are utilized to identify like parts.

First ramp member 162 comprises a ramp 166 mounted to a pivot arm member 168. Pivot arm member 168 includes a cylindrical sleeve 170, a generally horizontal mounting surface 172 and a generally vertical coupling surface 174. The cylindrical sleeve 170 is coupled around back member 76 as shown in FIGS. 16 and 17 so that pivot arm member 168 can pivot or rotate around back member 76. Ramp 166 is mounted onto the generally horizontal mounting surface 172 by, for example, the insertion of screws 176 and 178 as shown in FIG. 17. So mounted, the ramp 166 will also rotate about the back member 76.

As shown in FIG. 17, a retaining tab 180 is affixed to the underside of back member 76. Retaining tab 180 can comprise an L-shaped tab of metal welded to back member 76; the L shape creates a slot 182 between the edge the tab and the back member 76 that provides a space for the cylindrical sleeve 170 to rotate about the back member 76 without being interfered with by the retaining tab 180. A hole 184 formed in the retaining tab 180 enables the insertion therethrough of travel rod 186. Travel rod 186 is a rod having a bend 190 formed on one end. Stop member 188 keeps travel rod 186 from going all the way through hole 184. A spring 192 is placed onto the travel rod 186 and abuts against a second stop member 193. The bend 190 is then inserted into a hole 194 formed in the vertical coupling surface 174, and secured in place using, for example, a cotter pin or other conventional means.

So configured, when a force is exerted downward onto the ramp 166, it moves downward until it reaches a physical stopping point (e.g. contact with the ground); it is urged back to the upper position (in which the stop member 188 abuts with retaining tab 180) by spring 192 when the force is released from the ramp.

The second ramp member 164, as noted above, is essentially identical to the first ramp member 162, the difference being that second ramp member 164 is located on the opposite side of back member 76 as is first ramp member 162.

When a user with a wheelchair approaches the walker for entry, the wheels of the wheelchair act against the spring to urge the ramp down to the ground, providing easier access for the user. Once the user is in the walker and the wheelchair is removed, the ramp is released and returns to the normally upward position. Obviously, either ramp embodiment (dual smaller ramps or a single wide ramp) could be fixed or spring-loaded.

It is to be understood that although this invention has been described by reference to preferred embodiments, various modifications in shape, size, arrangement of parts, and materials may be resorted to without departing from the spirit or scope of the invention and these modifications are meant to be covered by the appended claims.

What is claimed is:

1. A walker for supporting an elderly or disabled person, said walker comprising:

a four-sided height adjustable upper support frame;

a four-sided lower base frame coupled to said upper support frame and having a plurality of wheels attached thereto, wherein said four-sided lower base frame includes spring-loaded ramp means for assisting in access to the device by an individual confined to a wheelchair wherein said spring-loaded ramp means is biased to an upper position to keep it from touching the ground and which can be urged to touch the ground by force exerted upon said spring-loaded ramp; and an adjustable seat assembly comprising:

a plurality of support straps suspended from said four-sided height adjustable upper frame;

adjustment means attached to said support straps for enabling the lengthening or shortening of the effective length of said support straps; and a set supported by said support straps.

2. A walker as set forth in claim 1, wherein one of the sides of said four-sided upper support frame comprises a moveable gate moveable into an open position to allow access to said walker.

3. A walker as set forth in claim 2, wherein said gate faces the rear of said walker so that access to or egress from the walker is accomplished from the rear.

4. A walker as set forth in claim 1, wherein said ramp means comprises a pair of ramps connected to one of the sides of said four-sided lower base frame.

5. A walker as set forth in claim 1, wherein said ramp means comprises a single wide ramp connected to one of the sides of said four-sided lower base frame.

6. A walker as set forth in claim 1, wherein said ramp means comprises a pair of spring-loaded ramps connected to one of the sides of said four-sided lower base frame.

7. A walker as set forth in claim 1, wherein said ramp means comprises a single wide spring-loaded ramp connected to one of the sides of said four-sided lower base frame.

8. A walker for supporting an elderly or disabled person, said walker comprising:

a four-sided upper support frame;

a four-sided lower base frame coupled to said upper support frame and having a plurality of wheels attached thereto; and a spring-loaded ramp, connected to one of said four sides of said lower base frame, for providing easier access to said walker by and individual confined to a wheel chair.

* * * * *